US005422657A

United States Patent [19]

Wang et al.

[11] Patent Number: 5,422,657

[45] Date of Patent: Jun. 6, 1995

[54] GRAPHICS MEMORY ARCHITECTURE FOR MULTIMODE DISPLAY SYSTEM

[75] Inventors: Shu-Wei Wang, Chungly; Wei K. Chia, Hsinchu; Chun-Kai Huang, Taichun; Chun-Chieh Hsiao, Taichu Hsien, all of Taiwan, Prov. of China

[73] Assignee: Industrial Technology Research Institute, Hsinchu, Taiwan, Prov. of China

[21] Appl. No.: 120,200

[22] Filed: Sep. 13, 1993

[51] Int. Cl.[6] ..... G09G 5/04

[52] U.S. Cl. ..... 345/186

[58] Field of Search ..... 345/186, 187, 201, 203

[56] References Cited

U.S. PATENT DOCUMENTS

| | | | |
|---|---|---|---|
| 5,047,760 | 9/1991 | Trevett et al. | 345/203 |
| 5,251,298 | 10/1993 | Nally | 345/203 |
| 5,280,578 | 1/1994 | Kamiyama et al. | 345/201 |

*Primary Examiner*—Jeffery Brier

*Attorney, Agent, or Firm*—Meltzer, Lippe, Goldstein, Wolf, Schlissel & Sazer

[57] ABSTRACT

A display memory architecture which efficiently stores and processes true color and index mode pixels is disclosed. The R, G and B components of true color mode pixels occupy different groups of bit planes in different banks of a frame memory. In addition, consecutive index mode pixels are located in not necessarily consecutive different groups of bit planes in consecutive banks so that a plurality of index mode pixels can be accessed simultaneously in reading and writing operations. Pixel swap circuits are used to swap the order of the R, G and B components of true color pixels and the order of simultaneously accessed index mode pixels, when the order of the accessed locations is different from the order in which R, G and B components of true color pixels or a plurality of index mode pixels are processed by a graphics processor.

11 Claims, 9 Drawing Sheets

TRUE COLOR MODE (CMS = 1)

INDEX COLOR MODE (CMS = 0)

TRUE COLOR MODE (CMS = 1)

GRAPHICS MEMORY ARCHITECTURE FOR MULTIMODE DISPLAY SYSTEM

FIELD OF THE INVENTION

The present invention relates to a display memory architecture. More particularly, the present invention relates to a display memory architecture that solves the problem of slow speed processing of index color pixels in a true color environment and thereby improves the processing of the entire graphics system.

BACKGROUND OF THE INVENTION

FIG. 1 illustrates a graphics system architecture 10. The graphics system architecture 10 includes a host computer 12 which comprises a CPU 14, a main system memory 16 and a disk memory 18 all interconnected by a system bus 20. The graphics system architecture 10 also includes a graphics subsystem 30. The graphics subsystem 30 includes a graphics processor 40 which is in communication with the system bus 20. The graphics subsystem 30 also includes a local bus 42 to which the graphics processor 40 is connected. A frame memory 50 is connected to the local bus 42. The frame memory 50 stores frame image data generated by the graphics processor 40. A Z-buffer 60 connected to the local bus 42 stores data related to depth of field for use in connection with the display of overlapping windows. The RAMDAC 62 is a digital-to-analog converter which mixes digital data from the frame memory 50 with screen control signals to generate analog signals compatible with the display 64.

The conventional architecture of the frame memory 50 is illustrated in FIG. 2. The frame memory 50 is formed from a plurality of VRAMs. The VRAMs are arranged, in a plurality of banks (e.g., bank 0, bank 1, bank 2, bank 3). Each bank comprises a plurality of buffers, e.g., buffer 0, buffer 1, buffer 2. The frame memory 50 is organized in a plurality of bit planes, e.g., twenty-four bit planes labeled 0, 1, . . . , 23, with eight bit planes in each buffer. Illustratively, the $4n^{th}$ pixel of every scanning line of the display 64 (see FIG. 1) is stored in bank 0, the $4n+1^{th}$ pixel of every scanning line is stored in bank 1, the $4n+2^{th}$ pixel is stored in bank 2 and the $4n+3^{th}$ pixel is stored in bank 3.

A true color pixel comprises twenty four bits, with one bit being stored in each bit plane. Illustratively, for a true color pixel in the frame memory 50 of FIG. 2, the R (Red) component occupies bit planes 0–7, the G (Green) component occupies bit plane 8–15, and the B (Blue) component occupies bit planes 16–23. (Instead of an RGB representation, true color pixels may be represented by two chrominance components and one luminance component). Illustratively, the local bus 42 has a width of thirty-two bits so that only one true color pixel can be accessed in (i.e., read from or written into) the frame memory 50 during each cycle. The local bus 42 transmits data in thirty-two bit words, with each bit position being labeled 0, 1, . . . , 31. A word for use on the local bus 42 is illustrated in FIG 3. As shown in FIG. 4, when a true color pixel is transmitted on the bus, the R component occupies bit positions 0–7, the G component occupies bit positions 8–15 and the B component occupies positions 16–23. The positions 23–31 are not used. Thus, there is a one-to-one correspondence between the twenty-four bit planes of the frame memory 50 of FIG. 2 and the first twenty-four bit positions of the data words on the data bus 42. The graphics processor 40 processes true color pixels based on the ordering of the R, G, B components shown in FIG. 4.

In addition to the true color mode, pixels may be also be stored using the index mode. In the index mode, each pixel is represented by 8 bits. The pixels (e.g., four consecutive pixels P1, P2, P3, P4) are conventionally stored in the frame memory 50 in the positions shown in FIG. 5 with consecutive pixels stored in consecutive banks. However, because of the one-to-one correspondence between bit planes in the frame memory and bit positions on the local data bus 42, only one eight bit index mode pixel location in the frame memory can be accessed in a cycle. Four consecutive index mode pixels cannot be accessed in a single cycle. The location of such a single index mode pixel (e.g., the pixel P2) in a data word on the data bus 42 is shown in FIG. 6. As shown in FIG. 6, twenty-four bit positions in the data word are unused. Thus, despite the fewer number of bits per pixel when the index color mode is used, no processing speed advantage is achieved; there is still only one pixel in each data word on the bus 42, i.e., one pixel per cycle.

FIG. 7 shows a prior art solution to this problem. An additional frame memory 80 is added to the frame memory 50. The additional frame memory 80 includes four buffers (buffer 0, buffer 1, buffer 2, buffer 3) and a total of 32 bit planes labeled 0, 1, . . . , 31. The consecutive index pixels P1, P2, P3, P4 each occupy eight bit planes, 0–7, 8–15, 16–23, 24–31, respectively. Because of the one-to-one correspondence between bit planes and bit positions in data words on the bus 42, the pixels P1, P2, P3, P4 may be accessed simultaneously and positioned in a data word on the bus 42 as shown in FIG. 8.

This enables four index color pixels to be processed in each cycle, thereby achieving a significant speed advantage, but the cost is additional memory capacity.

It is an object of the present invention to provide a frame memory architecture which overcomes the problems of the prior art and efficiently processes both true color and index color mode pixels. In particular, it is an object of the present invention, to provide a memory architecture which efficiently processes both true color and index mode pixels in single environment without the use of an additional frame buffer. It is also an object of the invention to provide a memory architecture for processing true color and index mode pixels in a manner which improves the speed and efficiency of the graphics system.

SUMMARY OF THE INVENTION

The present invention is a display memory architecture which efficiently stores and processes index mode and true color mode pixels.

In accordance with the present invention the R, G and B components of true color mode pixels occupy different groups of bit planes in different banks. In addition, consecutive index color pixels are located in different and not necessarily consecutive non-overlapping groups of bit planes in consecutive banks. With this arrangement the same memory buffer can be used for true color and index mode pixels. When the index mode is used, a plurality, e.g., four, index mode pixels can be accessed simultaneously during each cycle.

When a true color pixel is read from or written into the frame memory, the order of the R, G and B components depend on the bank to be accessed and may be different from the specific order of the R, G and B components utilized in the graphics processor. Thus, pixel swapping circuitry is used to convert between the order of the R, G and B components in the particular bank in which a pixel is located and the order of the R, G and B components utilized in the graphics processor. In addition, when the index mode is used, the pixel swapping circuits are used to swap between the order of the pixels in the bit planes of the memory and the consecutive order of index mode pixels used by the graphics processor.

DETAILED DESCRIPTION OF THE INVENTION

Figure 9:
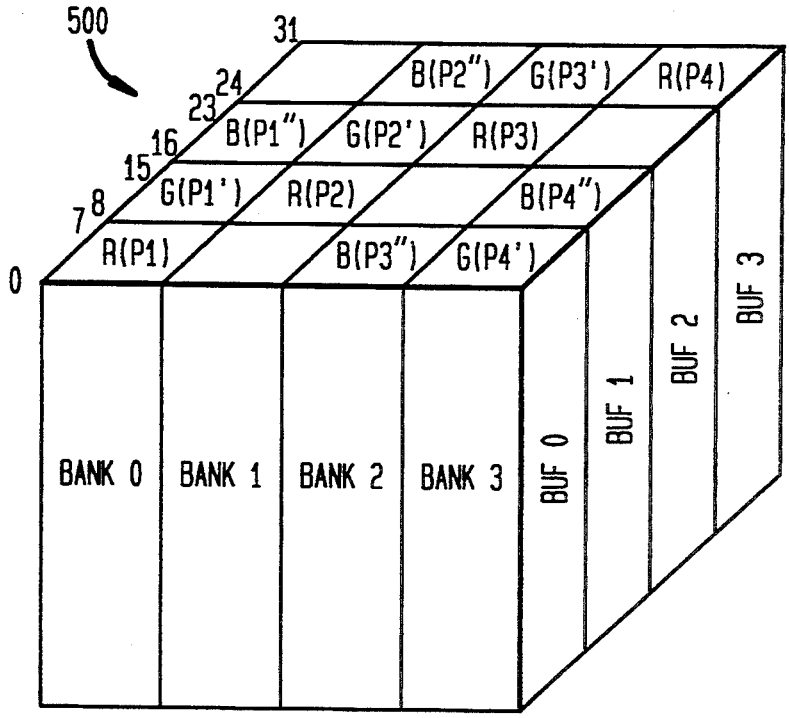
FIG. 9 shows an organization of a frame memory storing both index mode and true color mode pixels in accordance with the present invention.

FIG. 9 illustrates a frame memory organized in accordance with the present invention. The frame memory 50 of FIG. 9 is illustratively formed from a plurality of VRAM's. The VRAM's are arranged in four banks (Bank 0, Bank 1, Bank 2, Bank 3). Each bank is comprised of four buffers (buffer 0, buffer 1, buffer 2, buffer 3). There are thirty-two bit planes labeled 0, 1, . . . , 31. In the true color mode the R, G and B components of each pixel are stored in each bank in the particular bit planes shown in FIG. 9. In particular, as one moves from one bank to the next the R, G and B components are shifted clockwise in a cyclic fashion by one buffer, i.e,. by eight bit planes.

Figure 1:
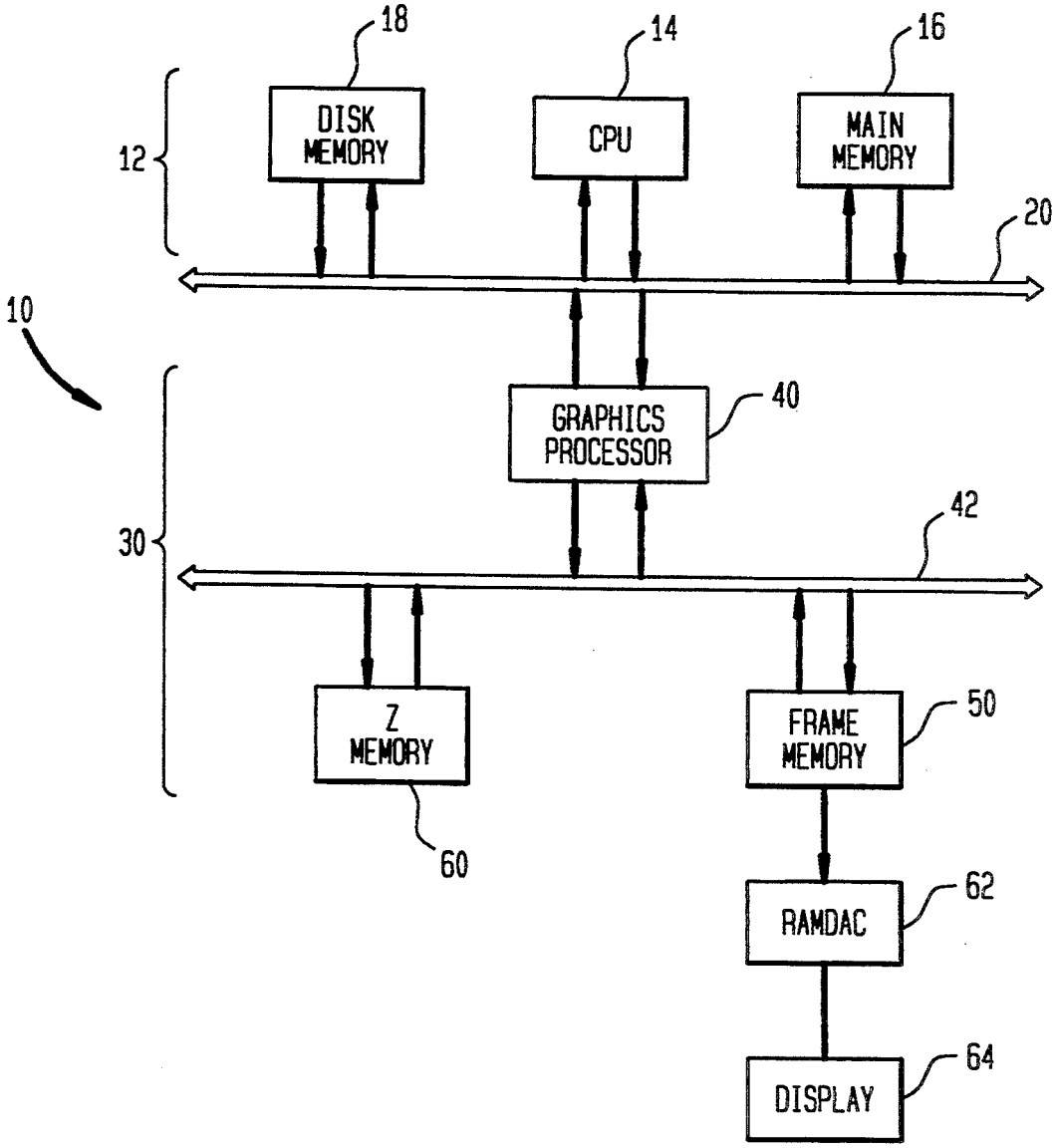
FIG. 1 illustrates a computer system with graphics capability.
Figure 2:
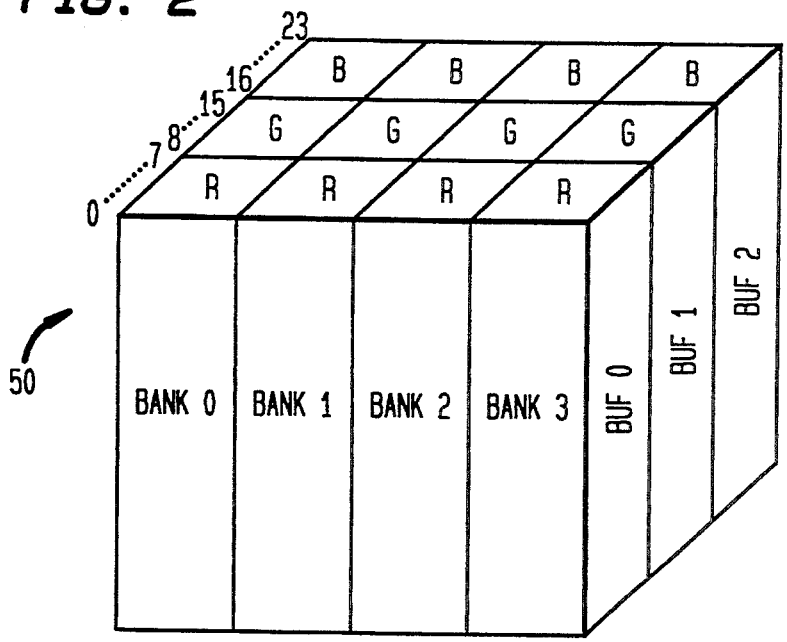
FIG. 2 illustrates the conventional organization of a frame memory which stores true color pixels for use in the system of FIG. 1.
Figure 3:
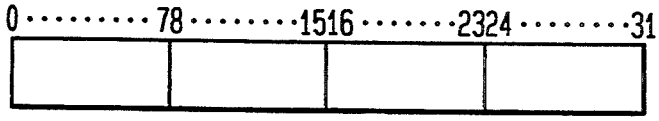
FIG. 3 illustrates the format of a data word on a local bus in the system of FIG. 1.
Figure 4:
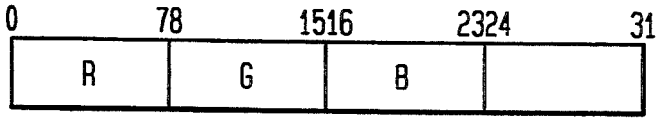
FIG. 4 illustrates the location of R, G and B components of a true color pixel in the data word of FIG. 3.
Figure 5:
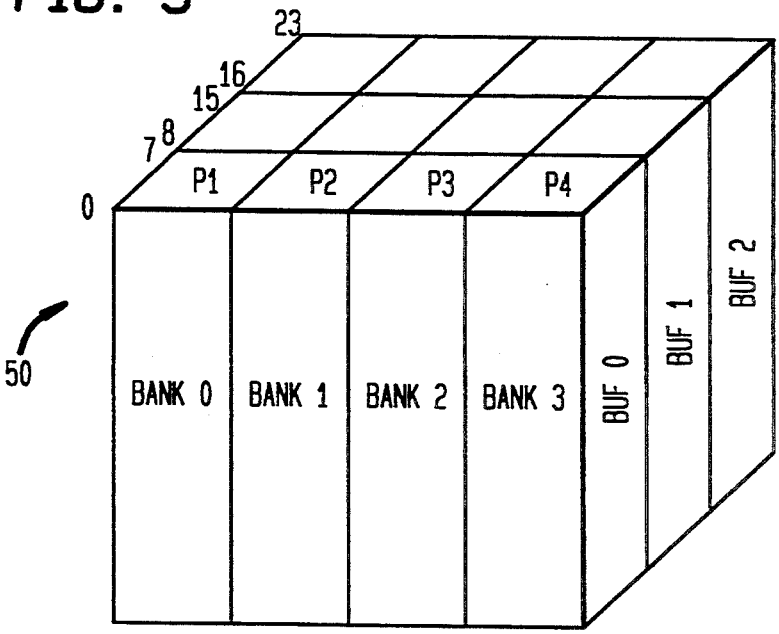
FIG. 5 illustrates the conventional organization of a frame memory which stores index color mode pixels.
Figure 6:
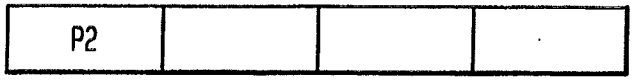
FIG. 6 illustrates a location of an index mode pixel in a data word on the local bus of the system of FIG. 1.
Figure 7:
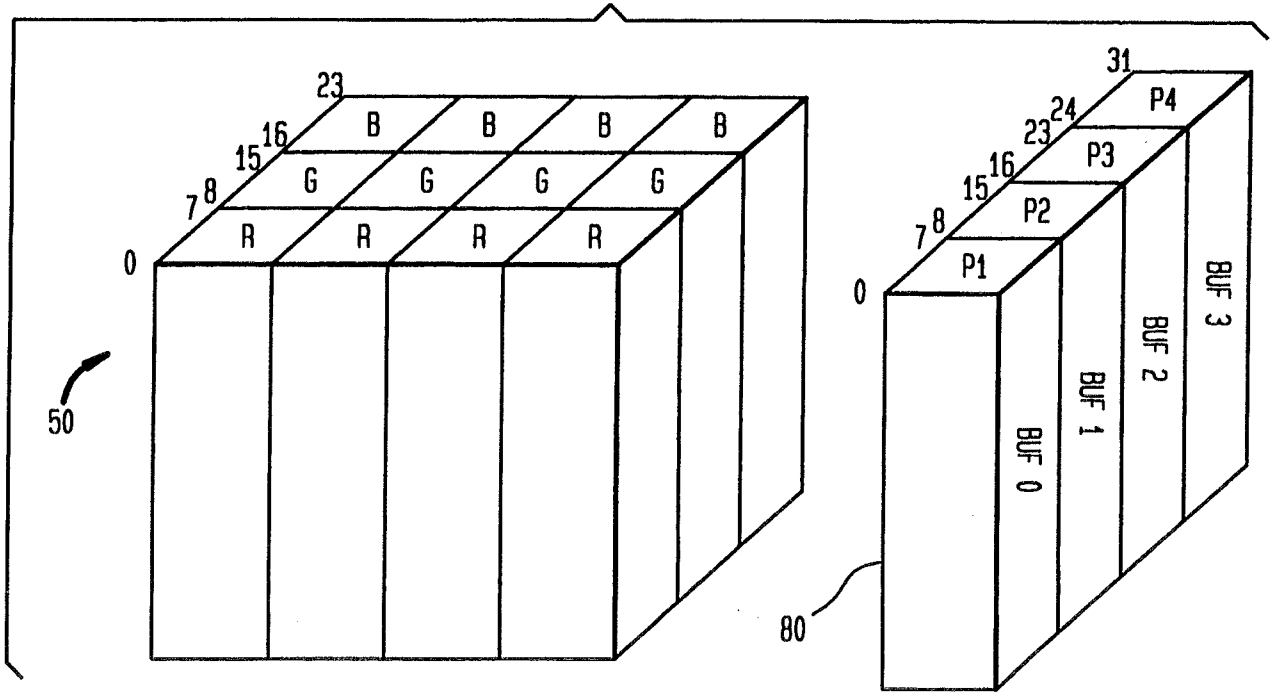
FIG. 7 illustrates a prior art frame memory architecture which stores both true color and index mode pixels.
Figure 8:
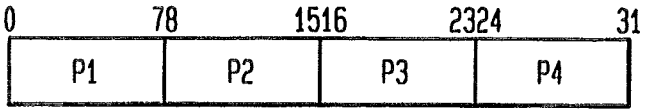
FIG. 8 shows a data word containing four index mode pixels simultaneously accessed from the frame memory of FIG. 7.
Figure 10A:
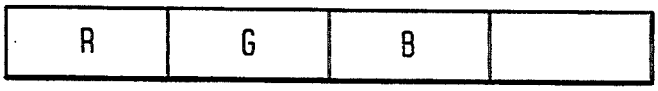
FIGS. 10(*a*), 10(*b*), 11(*a*), 11(*b*) illustrate the need for pixel swapping operations when the frame memory architecture of FIG. 9 is utilized.
Figure 10B:
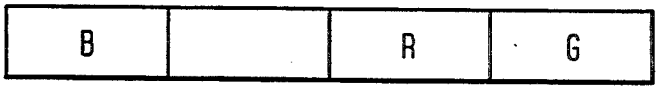

When a true color pixel is read from bank 0 in the memory 500 of FIG. 9, the word on the data bus 42 (see FIG. 1) has the format shown in FIG. 10(*a*). This is the order used by the graphics processor 40 to process true color pixels and no swapping is required. However, when a true color pixel is read from bank 1, bank 2 or bank 3, pixel swapping is necessary. For example, if a pixel is read from bank 3, the format of the word on the data bus 42 is as shown in FIG. 10(*b*). This is not a format useable by the graphics processor 40. Thus, the graphics processor 40 includes a pixel input swap circuit for swapping the bits in the word of FIG. 10(*b*) so that the format of FIG. 10(*a*) is achieved.

The graphics processor also includes a pixel output swap circuit. Data words generated by the graphics processor and containing a true color pixel have the format shown in FIG. 10(*a*). However, depending on the bank in the frame memory 500 into which the pixel is to be written, the order of the R, G and B components in the data word must be rearranged. For example, if the pixel is to be written into bank 3, the data word of FIG. 10(*a*) must be rearranged by the pixel output swap circuit to have the format of FIG. 10(*b*). The pixel input swap circuit and pixel output swap circuit are discussed in greater detail in connection with FIGS. 12, 13(*a*), 13(*b*), 14(*a*), 14(*b*), 15 and 16.

The frame memory 500 of FIG. 9 can also be used for index color pixels at the same time it is used for true color pixels. Thus, four consecutive index color pixels P1, P2, P3, P4 may be stored in the banks and bit planes indicated in FIG. 9 and corresponding to the R component locations for true color pixels. Four consecutive index color pixels P1', P1', P3', P4' may also be stored in the banks and bit planes indicated in FIG. 9 corresponding to the G component locations. Four consecutive index color pixels P1", P2", P3", P4" may also be stored in the banks and bit planes indicated in FIG. 9 corresponding to the B component locations. Thus, when used for index color pixels, the frame memory 500 of FIG. 9 may be viewed as a triple buffer, with one buffer corresponding to the R locations, a second buffer corresponding to the G location, and a third buffer corresponding to the B locations.

The pixel input swap circuit and pixel output swap circuit are also used for index color pixels.

Figure 11A:
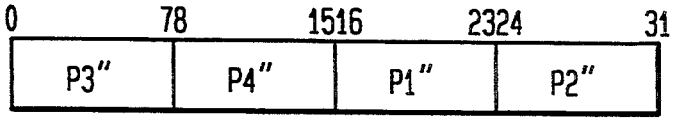
Figure 11B:
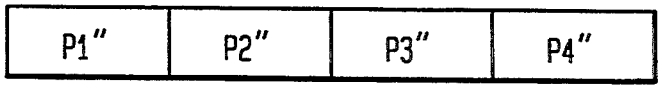

Consider the case where the B buffer is used to store index color pixels. In a cycle, four pixels may be read from the memory 500 of FIG. 9. Because there is a one-to-one correspondence between bit planes in the memory 500 and bit positions, the word which will be read from the memory in one cycle is shown in FIG. 11(*a*). However, the pixels P1", P2", P3", P4" are not consecutive. The graphics processor 40 on the other hand processes four consecutive index color pixels. Thus, the pixels in the data word of FIG. 11(*a*) are rearranged to the order shown in FIG. 11(*b*) by the pixel input swap circuit for processing by the graphics processor. Similarly, the graphics processor will generate words containing four consecutive index color mode pixels and having the format of FIG. 11(*b*). However, if this word is to be written into the B buffer, the pixel output swap circuit must rearrange the pixels to the format shown in FIG. 11(*a*).

Figure 12:
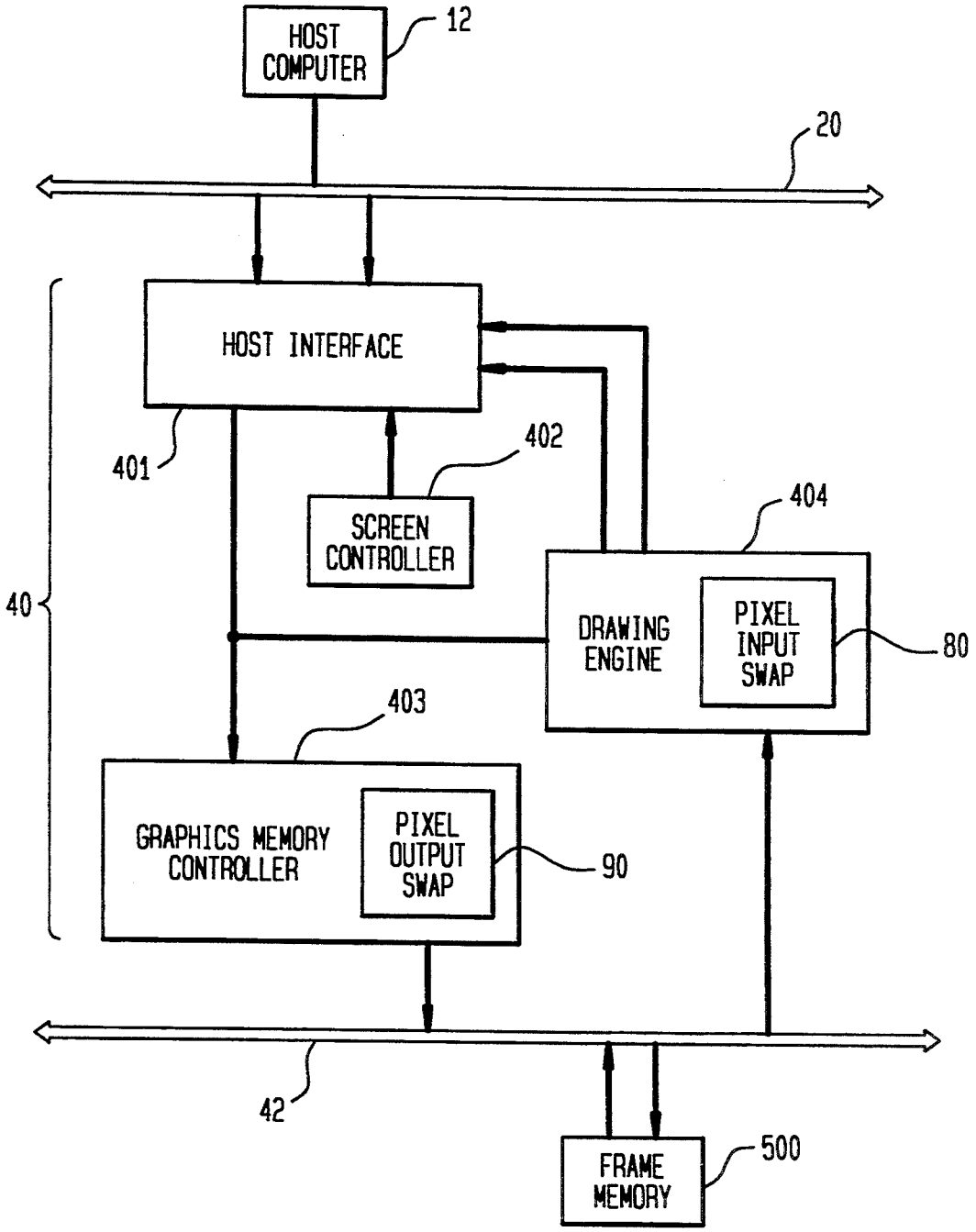
FIG. 12 illustrates a graphics processor including pixel input swap and pixel output swap circuits according to the present invention.

FIG. 12 illustrates the graphics processor 40. The graphics processor 40 comprises a host interface 401 which is connected via the system bus 20 to this host computer 12 (see FIG. 1). The graphics processor 40 also includes a conventional screen controller 402, a graphics memory controller 403, and a drawing engine 404. The drawing engine receives pixels from the frame memory 500 via the local bus 42 and includes a pixel input swap circuit 80. As indicated above, for true color pixels, the pixel input swap circuit 80 rearranges the location of the R, G and B components in a pixel read out of the frame memory 500 (see FIG. 9) so that the first three bytes of a data word contains the R, G and B components in order. For index color pixels, the pixel input swap circuit 80 rearranges four index color pixels in a data word read from the memory 500 so that the index color pixels are consecutive.

The graphics memory controller 403 outputs pixels to be transmitted to the frame memory 500 via the bus 402 and written into the frame memory 500. The graphics memory controller 403 includes a pixel output swap circuit 90. The pixel output swap circuit 90 receives true color pixels whose R, G and B components are located in the first three bytes of a four byte word and rearranges the R, G and B components so that the pixel may be written into a particular bank in the memory 500. For index color pixels, the pixel output swap circuit 90 receives four consecutive index color pixels in a four byte word and reorders the index color pixels so they may be written into one of the three (R,G or B) index color buffers in the memory 500.

Figure 13A:
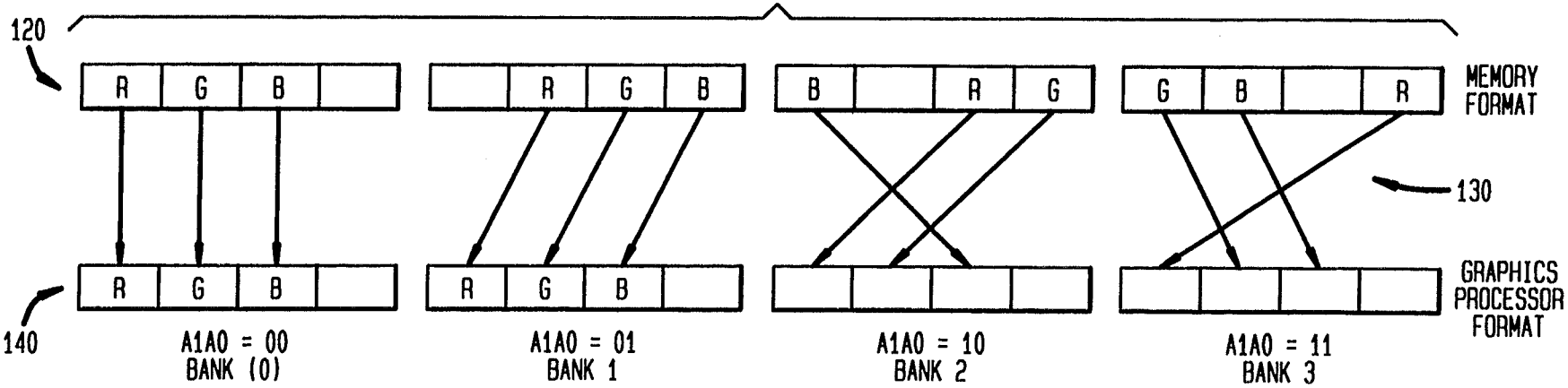
FIGS. 13(*a*) and 13(*b*) summarize the swapping operations performed by the pixel input swap circuit of FIG. 12.
Figure 13B:
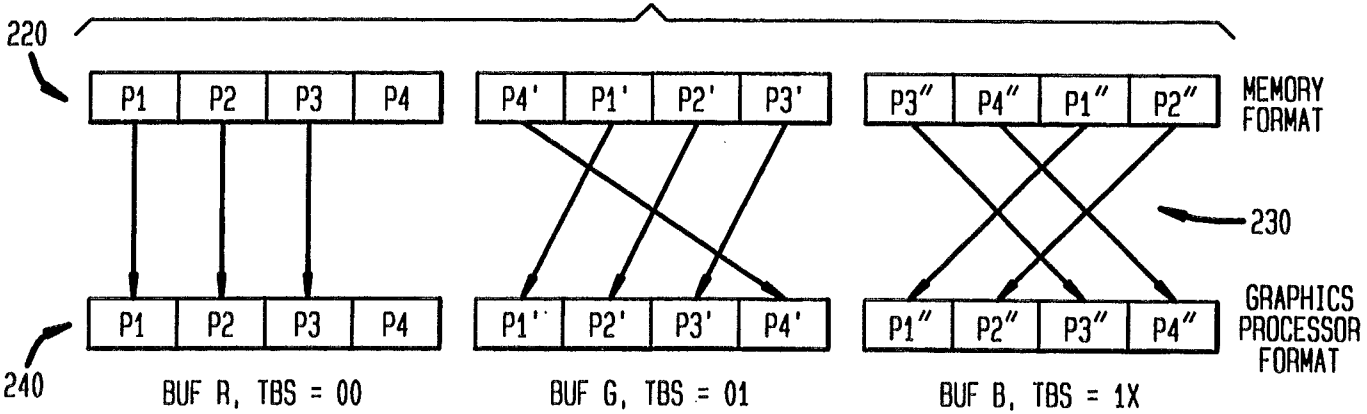

FIG. 13(*a*) and FIG. 13(*b*) summarize, respectively, the operations performed by the pixel input swap circuit on true color and index color pixels. The control signal CMS=1 for operation in the true color mode and CMS=0 for operation in the index color mode. For the true color mode (CMS=1), the control signal A1A0, which is formed from the lowest two bits of the pixels X coordinate, indicates from which bank in the frame memory 500 the pixel is read. The top line 120 of data words in FIG. 13(*a*) contains a data word read from each of the banks 0,1,2,3 of the frame memory 500. The pixels are swapped according to a particular pattern 130 depending on A1A0 to generate data words wherein the R, G and B components are always in the first three bytes for processing by the graphics processor as shown in the bottom line 140 of FIG. 13(*a*).

For the index color mode (CMS=0), the signals TBS=00, 01, 1x indicate which of the three buffers (R,G, or B locations in FIG. 9) is used. The swapping 230 for each case is shown in FIG. 13(*b*), wherein the top line 220 contains the data words read from the frame memory and the bottom line 240 is the desired format for the graphics processor.

Figure 14A:
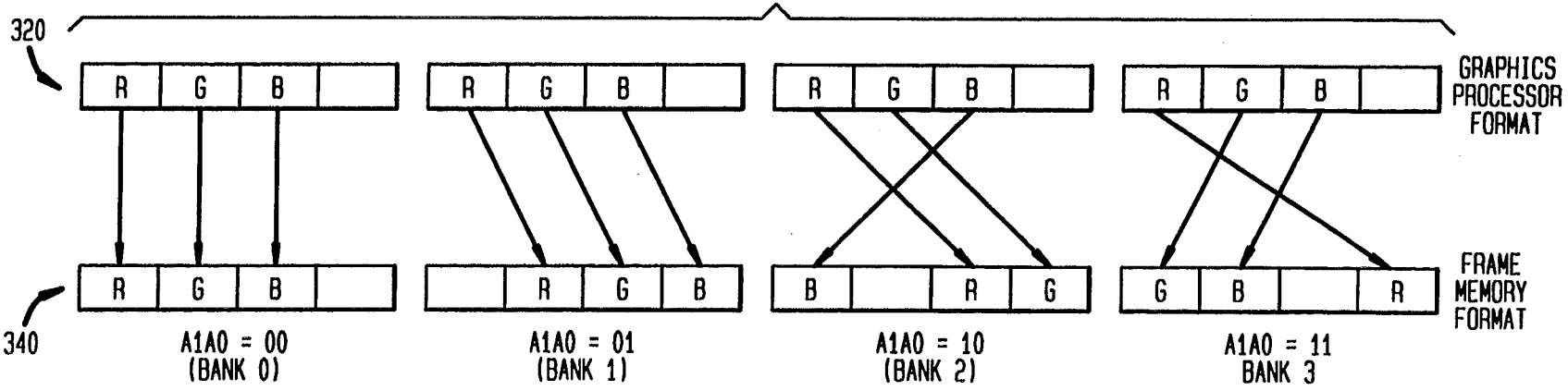
FIGS. 14(*a*) and 14(*b*) summarize the swapping operations performed by the pixel output swap circuit of FIG. 12.
Figure 14B:
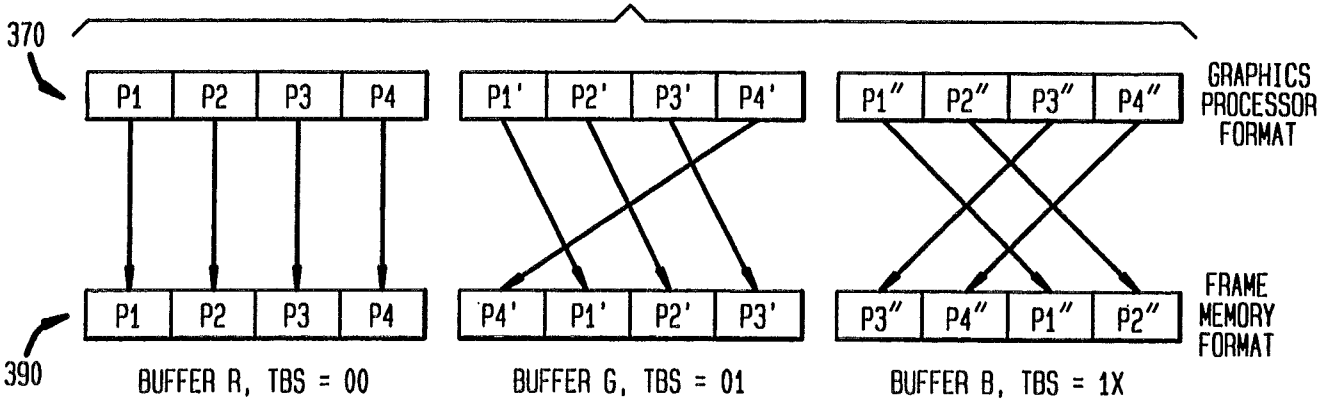

FIG. 14(*a*) and FIG. 14(*b*) summarize, respectively, the operations performed by the pixel output swap circuit on the true color and index mode pixels. The input of the pixel output circuit as generated by the graphics processor is shown in the top line 320 of FIG. 14(*a*) and 370 FIG. 14(*b*). The bottom lines 340 and 390 in FIG. 14(*a*) and 14(*b*) show the result of the swapping operation so that the pixels are in a form to be written into the memory 500. In the case of the true color mode (CMS=1), the control signal A1A0 indicates the bank the word in the line 340 is to be written into. In the case of the index mode (CMS=0), the control signal TBS indicates which of the triple buffers (R, G or B) is to be written into.

Figure 15:
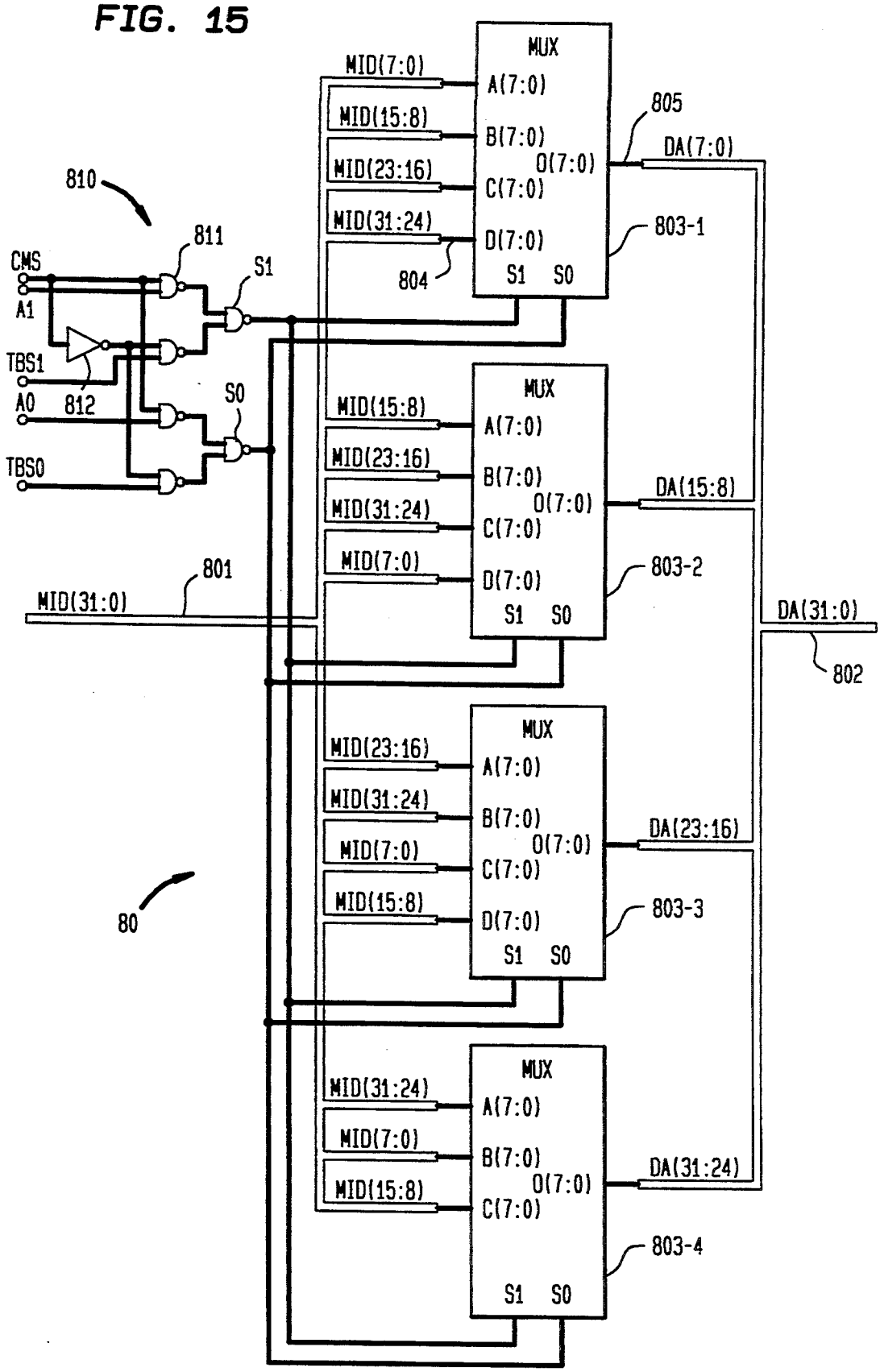
FIG. 15 is a circuit diagram of pixel input swap circuit.

FIG. 15 illustrates the pixel input swap circuit 80. Thirty-two bit wide data words read from the memory 500 arrive on the bus 801. Thirty-two bit wide data words leave on the bus 802 for processing in the graphics processor. The swapping operation is performed by the four multiplexers 803-1, 803-2, 803-3, 803-4. Each multiplexer 803-1, 803-2, 803-3 has four eight-bit inputs 804 for receiving eight bits from the thirty-two bit data words on the bus 801. For example, input A of MUX 803-1 receives bits 0–7, input B of MUX 803-1 receives bits 8–15, input C of MUX 803-1 receives bits 16–23, input D of MUX 803-1 receives bits 24–31. The MUX 803-4 has three inputs, i.e, input A which receives bits 24–31, input B which receives bits 0–7, and input C which receives bits 8–15. Each MUX 803 has an output 805. Each MUX 803 transmits to its output 805 the eight bits present at one of its inputs (A, B, C, D). The output of MUX 803-1 forms bits 0–7 of the output data word on bus 802, the output of MUX-2 forms bits 8–15 of the word on bus 802, the output of MUX 803-3 forms bits 16–23 of the word on bus 802, and the output of MUX 803-4 forms bits 23–31 of the word on the bus 802.

Each MUX 803 receives two control bits S0, S1 which control which input A, B, C or D is transmitted to the output. The control bits S0, S1 are generated by the control logic 810. The control logic 810 comprises six NAND gates 811 and one inverter 812. The inputs to the control logic are CMS which selects the true color or index mode, A1A0 which selects the bank in the true color mode (see FIG. 13(*a*)) and TBS [0, 1] which selects the buffer (R, G or B) in the index mode.

Figure 16:
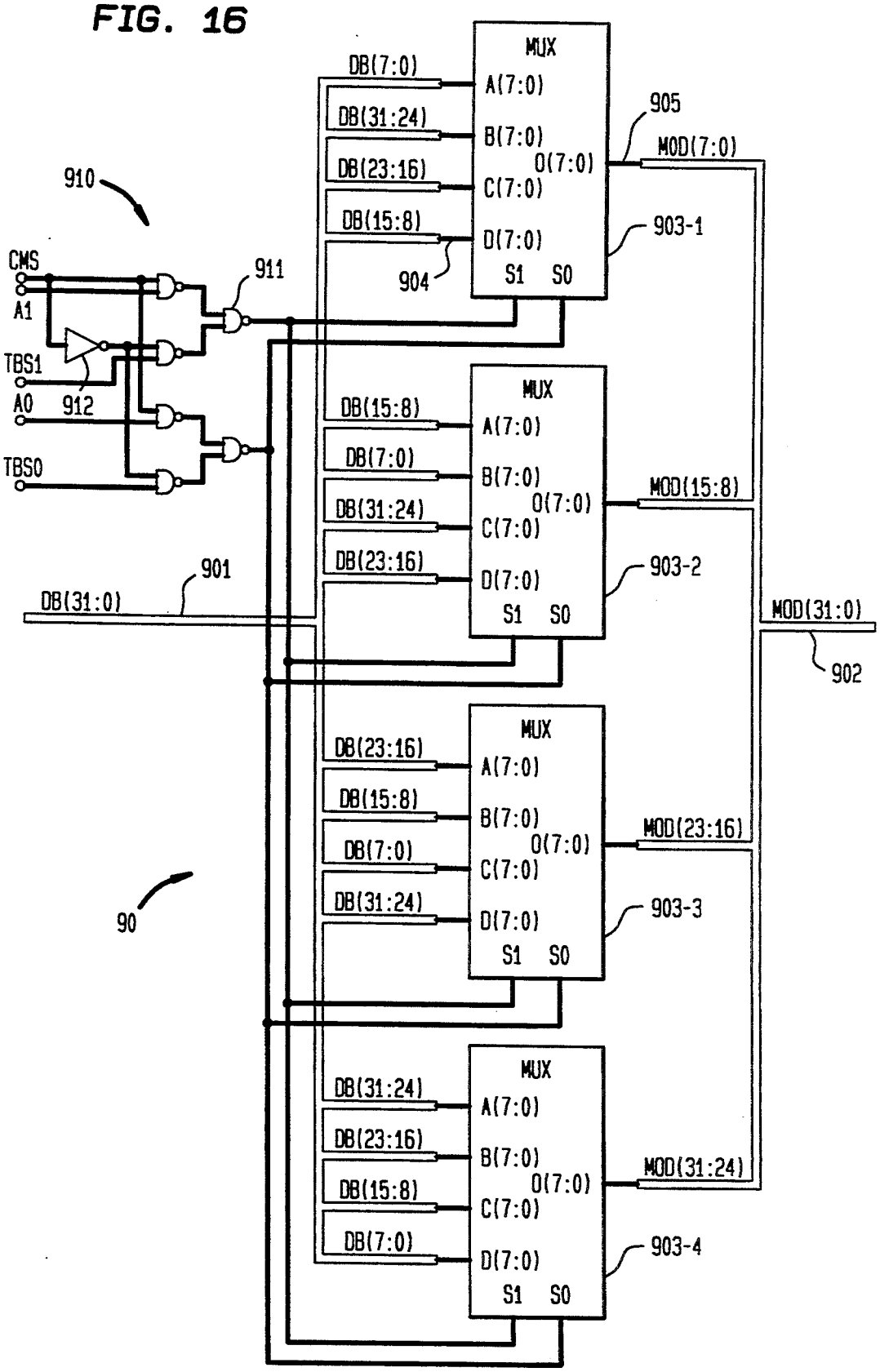
FIG. 16 is a circuit diagram of a pixel output swap circuit.

The output pixel swap circuit 90 shown in FIG. 16 has a similar construction. A word from the graphics processor arrives on thirty-two bit bus 901. A thirty-two bit word in a format suitable for writing into the frame memory 500 (see FIG. 9) is outputted on the bus 902. The output pixel swap circuit comprises four multiplexers 903-1, 903-1, 903-3, 903-4. Each MUX 903 has four eight bit inputs 804 for receiving eight bits from the thirty-two bit data word on the bus 901. For example, input A of MUX 903-1 receives bits 0–7, and input B of MUX 903-1 receives bits 8–15, input C receives bits 16–23, input D receives bits 24–31. Each MUX 903 has an output 905. Each MUX 903 transmits to its output 905 the eight bits present at one of its inputs (A, B, C, D). The output of MUX 903-1 forms bit 0–7 of the output word on bus 902, the output of MUX 903-2 forms bits 8–15 of the word on bus 902, the output of MUX 903-3 forms bits 16–23 of the word on bus 902, the output of MUX 903-4 forms bits 23–31 of the word on the bus 902.

Each MUX 903 receives two control bits S0, S1 for determining which input A, B, C or D is transmitted to the output. The control bits S0, S1 are generated by the control logic 910. The control logic 910 comprises six NAND gates 911 and one inverter 912. The inputs to the control logic 910 are CMS which selects true color or index mode, A1A0 which selects the bank in the true color mode (see FIG. 14(*a*)) and TBS[0,1] which selects the buffer (R, G or B) in the index mode.

In short, a display memory architecture has been disclosed which processes index pixels in a true color environment with a high level of speed and efficiency. Finally, the above-described embodiments of the invention are intended to be illustrative only. Numerous alternative embodiments may be devised by those skilled in the art without departing from the spirit and scope of the following claims.

We claim:

1. A display memory architecture comprising a graphics processor, a frame memory comprising a plurality of banks each of which banks is organized into a plurality of bit planes, said frame memory being capable of storing a plurality of components of true color pixels in different groups of bit planes in different ones of said banks, said frame memory being capable of storing consecutive index mode pixels in different groups of bit planes in different banks so that a plurality of index mode pixels can be accessed simultaneously in reading and writing operations, and pixel swapping circuitry associated with said graphics processor for swapping the order of the components of said true color pixels and the order of a plurality of index mode pixels when the order of the true color pixel components and the order of the index mode pixels in said memory is different from the order in which said components of said true color pixels and said index mode pixels are processed by said graphics processor.

2. The memory architecture of claim 1 wherein said frame memory includes a plurality of buffers for index mode pixels, each buffer for index mode pixels being comprised of locations in said memory used to store one of the components of said true color pixels.

3. The memory architecture of claim 1 wherein said components of said true color pixels are R, G and B and there are three buffers defined for index mode pixels.

4. The memory architecture of claim 2 wherein said pixel swapping circuitry includes a pixel input swap circuit for receiving data words containing the components of true color pixels read from particular banks of said memory and data words containing a plurality of index mode pixels simultaneously read from said memory and for rearranging said components and said index mode pixels in said data words into a format suitable for processing by said graphics processor.

5. The memory architecture of claim 4 wherein said pixel input swap circuit comprises an input bus for receiving said data words containing said components and index mode pixels as read from said memory, an output bus for transmitting said data words in said rearranged format suitable for processing by said graphics processor, multiplexer means located between said input and output buses, and control logic for controlling said multiplexer means.

6. The memory architecture of claim 5 wherein said control logic receives a first control signal for distinguishing between true color and index mode pixels, a second control signal for identifying a particular bank for a true color pixel, a third control signal for identifying a particular one of said buffers for a group of index mode pixels.

7. The memory architecture of claim 4 wherein said pixel swapping circuitry further comprises a pixel output swap circuit for receiving data words containing the components of true color pixels in a predetermined order and data words containing a plurality of index mode pixels in a predetermined order and for rearranging said received data words into a format suitable to write said true color pixels into particular banks in said memory and to write said index mode pixels into particular buffers in said memory.

8. The memory architecture of claim 7 wherein said pixel output swap circuit comprises an input bus for receiving said data words, an output bus for transmitting said data words in said rearranged format suitable for writing into said memory, multiplexer means located between said input and output buses, and control logic for controlling said multiplexer means.

9. The memory architecture of claim 8 wherein said control logic receives a first control signal for distinguishing between true color and index mode pixels, a second control signal for identifying a particular bank for a true color pixel, a third control signal for identifying a particular one of said buffers for a group of index mode pixels.

10. The memory architecture of claim 9 wherein said graphics processor comprises a host interface in communication with a host computer, a screen controller connected to said host interface, a graphics memory controller for transmitting pixels to said frame memory, and a drawing engine for receiving pixels from said frame memory, said pixel output swap circuit being connected to said graphics memory controller, said pixel input swap circuit being connected to said drawing engine.

11. The memory architecture of claim 1 wherein said frame memory comprises a plurality of VRAMs.

* * * * *